US010138442B2

(12) United States Patent
Gaudreault

(10) Patent No.: US 10,138,442 B2
(45) Date of Patent: Nov. 27, 2018

(54) OUTDOOR CLEANING SYSTEM CONCENTRATES

(71) Applicant: Jelmar LLC, Skokie, IL (US)

(72) Inventor: Rosemary A. Gaudreault, Park Ridge, IL (US)

(73) Assignee: Jelmar, LLC, Skokie, IL (US)

( * ) Notice: Subject to any disclaimer, the term of this patent is extended or adjusted under 35 U.S.C. 154(b) by 0 days.

(21) Appl. No.: 15/360,766

(22) Filed: Nov. 23, 2016

(65) Prior Publication Data

US 2018/0142185 A1 May 24, 2018

(51) Int. Cl.

| | |
|---|---|
| ***C11D 1/00*** | (2006.01) |
| ***C11D 1/88*** | (2006.01) |
| ***C11D 3/10*** | (2006.01) |
| ***C11D 3/22*** | (2006.01) |
| ***C11D 3/48*** | (2006.01) |
| ***C11D 1/66*** | (2006.01) |
| ***B05B 7/24*** | (2006.01) |
| ***C11D 1/04*** | (2006.01) |
| ***C11D 1/10*** | (2006.01) |
| ***C11D 1/72*** | (2006.01) |
| ***C11D 1/75*** | (2006.01) |
| ***C11D 3/20*** | (2006.01) |

(52) U.S. Cl.

CPC ..... *C11D 1/662* (2013.01); *B05B 7/24* (2013.01); *C11D 1/04* (2013.01); *C11D 1/10* (2013.01); *C11D 1/72* (2013.01); *C11D 1/75* (2013.01); *C11D 1/88* (2013.01); *C11D 3/10* (2013.01); *C11D 3/2086* (2013.01); *C11D 3/48* (2013.01)

(58) Field of Classification Search

CPC .. C11D 1/00; C11D 1/662; C11D 1/88; C11D 3/10; C11D 3/2075; C11D 3/22; C11D 3/48

See application file for complete search history.

(56) References Cited

U.S. PATENT DOCUMENTS

| | | | | |
|---|---|---|---|---|
| 9,434,910 | B2 * | 9/2016 | Gaudreault | C11D 3/2068 |
| 2014/0199416 | A1 * | 7/2014 | Gaudreault | C11D 3/2068 424/717 |

* cited by examiner

*Primary Examiner* — Brian P Mruk

(74) *Attorney, Agent, or Firm* — Richard D. Harris

(57) ABSTRACT

An outdoor cleaning concentrate composition having improved dirt and stain cleaning properties on outdoor surfaces, that is less corrosive and capable of being used with a water spraying system; and that is environmentally friendly. The outdoor cleaning concentrate composition includes the following components: a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates; a fungicide; a chelating agent; a disinfectant; and a specific pH range. The surfactant is preferably an alkyl glucoside; more preferably, caprylyl/decyl glucoside. The fungicide is preferably potassium bicarbonate, while the disinfectant is preferably potassium carbonate.

32 Claims, No Drawings

OUTDOOR CLEANING SYSTEM CONCENTRATES

BACKGROUND OF THE INVENTION

This disclosure relates generally to outdoor cleaning compositions and systems, and more specifically relates to compositions and system concentrates for cleaning dirt and stains from a variety of outdoor surfaces, that are also environmentally friendly.

BACKGROUND OF THE INVENTION

Outdoor cleaning compositions have been known and used for a variety of outdoor surfaces, such as wooden and concrete floors, fences, house siding and exterior surfaces, outdoor furniture, as well as plastic, fiberglass composite or laminated materials. Often times, outdoor surfaces accumulate dirt, grime and stains due to pollen, bird and insect droppings, spider webs and rust. Particularly, mold and mildew stains grow on many outdoor surfaces, most frequently in shady and moist areas where water or humidity is present.

Outdoor cleaning compositions have been formulated to address both the cleaning of dirt, as well as the removal of stains such as mold and mildew stains. Compositions for removing mold and mildew stains have traditionally contained a higher pH level, such as 10.0 and higher. While high pH solutions have been effective at removing mold and mildew stains, their high pH levels pose problems for the cleaner, as well as for the surface that is being cleaned. First of all, direct contact with a high pH solution can dry out or even burn the skin; protective gloves must often be worn by the user. Furthermore, the high pH solutions can also corrode hard surfaces while removing the stain. Prolonged exposure to a high pH cleaning solution can often result in corrosion to more delicate household surfaces.

It has also become important for outdoor cleaning compositions to be formulated in such a way as to have less impact on the environment (to be "green"), and to be safe for use around lawns and plants. One way in which this is encouraged is through a program of the United States Environmental Protection Agency, known as the Design for the Environment Program ("DfE"). DfE certifies "green" cleaning products through the Safer Product Labeling Program. Another is through state regulatory bodies, such as the California Air Resources Board ("CARB"). Either through regulation, or through certification, these bodies set out standards for achieving environmentally friendly cleaning products. Among the standards, are the desire for a composition that is not as corrosive as prior art products, one having a lower basic pH level.

Also, many current outdoor cleaning products require substantial scrubbing and/or a special high pressure spraying system. Those types of systems are typically time-consuming for cleaning large outdoor surface areas, and may still be ineffective for removing mold and mildew stains.

Accordingly, it is desirable to provide an effective outdoor cleaning composition, which is less corrosive than existing compositions for safer handling by the user, and to reduce the corrosive effects on the applied surfaces and surrounding environment.

It is further desirable to provide an effective outdoor cleaning composition and system, a concentrate which can be used with a regular garden hose for more convenient handling by the user.

It is yet further desirable to find a cleaning composition, which may be applied to a variety of outdoor surfaces, and which meets any and all applicable environmental standards and regulations, with a specific combination of surfactants, fungicides or disinfectants, chelating agents, and preservatives—all of which act in a synergistic manner to improve their effectiveness in cleaning dirt and removing stains, while ensuring a less corrosive lower basic pH.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

One aspect of the present invention is directed to an outdoor cleaning concentrate composition, which comprises a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines, and sarcosinates, a fungicide, a chelating agent, and a disinfectant comprising potassium carbonate; that is easier to handle and environmentally friendly; towards effectively cleaning dirt and stains, such as mold and mildew stains, from outdoor surfaces. The pH of the outdoor cleaning composition, in its concentrate form, may range from about 9.4 to about 9.8. In a preferred embodiment of the invention, the disinfectant may comprise about 3.5 wt. % to about 9.5 wt. % of the outdoor cleaning concentrate composition.

In one embodiment of the invention, the surfactant exhibits a low surface tension. In one preferred embodiment of the invention, the surfactant comprises an alkyl glucoside. In a more specific preferred embodiment, the surfactant is caprylyl/decyl glucoside. The surfactant may comprise about 2 wt. % to about 7.5 wt. % of the outdoor cleaning concentrate composition.

In another embodiment of the invention, the fungicide is selected from the group consisting of potassium bicarbonate, sodium bicarbonate, potassium carbonate, sodium carbonate, silver, cadmium, sulfur, tea tree oil, cinnamon essential oil, jojoba oil, neem oil, rosemary oil, monocerin, milk, and amepelomyces quisqualis AQ10. In a further preferred embodiment of the invention, the fungicide is potassium bicarbonate. The fungicide may comprise about 6 wt. % to about 12 wt. % of the outdoor cleaning concentrate composition.

In yet another embodiment of the invention, the chelating agent is selected from the group consisting of sodium gluconate, a salt of methyl glycine diacetic acid, L-tartaric acid, potassium sodium tartrate, potassium tartrate, trisodium citrate, monosodium citrate, tripotassium citrate, monopotassium citrate, sodium lactate, and DL-malic acid. In a preferred embodiment of the invention, the chelating agent is selected from the group consisting of sodium gluconate and a salt of methyl glycine diacetic acid. In yet another preferred embodiment of the invention, the chelating agent is a first chelating agent, and the composition further comprises a second chelating agent. The total amount of the chelating agents may range from about 7 wt. % to about 21 wt. % of the composition. In one preferred embodiment of the invention, the first chelating agent and the second agent are selected from the group consisting of sodium gluconate, a salt of methyl glycine diacetic acid, L-tartaric acid, potassium sodium tartrate, potassium tartrate, trisodium citrate, monosodium citrate, tripotassium citrate, monopotassium citrate, sodium lactate, and DL-malic acid. In a more specific embodiment, the first chelating agent is sodium gluconate, and the second chelating agent is a salt of methyl glycine diacetic acid. The first chelating agent may comprise about 4 wt. % to about 11 wt. % of the outdoor cleaning concentrate composition, and the second chelating agent may comprise about 3 wt. % to about 10 wt. % of the outdoor cleaning concentrate composition.

In yet another embodiment of the invention, the outdoor cleaning concentrate composition further comprises at least one preservative. Preferably, the preservative comprises sodium lactate. The preservative may comprise about 0.75 wt. % to about 2.25 wt. % of the composition.

In another embodiment of the invention, the outdoor cleaning concentrate composition further comprises a diluent. The diluent may comprise about 35.5 wt. % to about 80.75 wt. % of the composition.

In yet another embodiment of the invention, the outdoor cleaning concentrate composition is to be diluted to form a diluted outdoor cleaner for cleaning dirt and stains from an outdoor surface. Preferably, the diluted outdoor cleaner may effectively remove mold and mildew stains. In one embodiment of the invention, the outdoor cleaning concentrate composition is diluted with water at a dilution rate of about 1:19. After the dilution, the diluted cleaner may have a pH ranging from about 9.55 to less than 10.

In another preferred embodiment of the invention, the outdoor cleaning composition comprising a surfactant comprising caprylyl/decyl glucoside, ranging from about 2 wt. % to about 7.5 wt. % of the composition; a fungicide comprising potassium bicarbonate, ranging from about 6 wt. % to about 12 wt. % of the composition; a disinfectant comprising potassium carbonate, ranging from about 3.5 wt. % to about 9.5 wt. % of the composition; one or more chelating agents, ranging from about 7 wt. % to about 21 wt. % of the composition; a preservative comprising sodium lactate, ranging from about 0.75 wt. % to about 2.25 wt. % of the composition; and a diluent, ranging from about 35.5 wt. % to about 80.75 wt. % of the composition, in which the outdoor cleaning concentrate composition has a pH ranging from about 9.4 to about 9.8. The chelating agents may comprise two chelating agents, a first chelating agent comprising sodium gluconate and a second chelating agent comprising a salt of methyl glycine diacetic acid.

Another aspect of the invention is directed an outdoor cleaning system for cleaning dirt and stains from an outdoor surface, in which the invention further comprises a container for containing, diluting and distributing the present outdoor cleaning concentrate composition. In this embodiment, the outdoor cleaning concentrate composition can be diluted with water to form a diluted cleaner. The container is configured to cooperate with a sprayer nozzle attachable to a garden hose, for spraying the diluted cleaner onto, and for rinsing the diluted cleaner from, one or more outdoor surfaces, with a stream of water passing through the garden hose, the nozzle and the container. In one preferred embodiment, the cleaning system may be used for removing mold and mildew stains from one or more outdoor surfaces.

The feature or features of any one embodiment may be applied to yet other embodiments even though not described or illustrated, unless expressly prohibited by this disclosure or the nature of the embodiments.

Details associated with the embodiments described hereinabove and others are described below.

DETAILED DESCRIPTION

While this invention is susceptible of embodiment in many different forms, there are described herewithin several specific embodiments, with the understanding that the present disclosure is to be considered as an exemplification of the principals of the invention and is not intended to limit the invention to the embodiments so described.

Generally speaking, various embodiments of the present invention provide for compositions and systems for cleaning dirt and stains, particularly mold and mildew stains, from a variety of outdoor surfaces, such as wooden and concrete floors, fences, house siding and exterior surfaces, outdoor furniture, as well as plastic, fiberglass composite or laminated materials. The present invention includes a cleaning concentrate composition that is effective at removing dirt, mold and mildew, while protecting outdoor surfaces from the deleterious effects of corrosion, and safeguarding the environment. The concentrate composition may be diluted with water (e.g., tap water) at a desired dilution rate (e.g., 1:19) to form a diluted outdoor cleaner solution—which can be sprayed onto outdoor surfaces, by a water spraying system, including a container with a sprayer nozzle attachable to a garden hose.

The outdoor cleaning concentrate composition of the present application comprises at least a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates; a fungicide; and a chelating agent. In a preferred embodiment of the invention, the outdoor cleaning concentrate composition further comprises a disinfectant. The concentrate composition may further comprise another chelating agent, a diluent, and/or a preservative.

The surfactant in the present outdoor cleaning concentrate composition performs the very important function of acting to physically separate a contaminating substance, from the surface or material to which the contaminating substance is adhered. Preferably, the surfactant must have a low surface tension and excellent wetting capabilities, in order to allow the composition to penetrate the soil and stains. The fungicide works to increase the effectiveness of the present outdoor cleaning concentrate composition, which may assist in preventing the growth of fungi both in the composition and on the surface after it is applied. In some preferred embodiments, a combination of the fungicide and the disinfectant in the present outdoor cleaning concentrate composition is especially helpful for removing the mold and mildew stain, as well as any other bacterial and fungal organisms that may have accumulated due to organic wastes in contact with the outdoor surfaces and substrates. The chelating agents act to remove metal ions, which are required to sustain the underlying bacterial and fungal components of the stain, and further assist in their adherence to the outdoor surface.

In a preferred embodiment of the invention, the outdoor cleaning concentrate composition includes a surfactant, a fungicide, a disinfectant, two chelating agents, a preservative and a diluent.

The Surfactant

As stated above, preferably the surfactant has a low surface tension and excellent wetting capabilities. The present outdoor cleaning concentrate may include at least a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates.

The surfactant preferably comprises an alkyl glucoside. Alkyl glucosides are a class of non-ionic surfactants widely used in a variety of cleaning applications, and in many cases it is an advantage that they are biodegradable. Alkyl glucosides may be formed by reacting an alcohol or mixtures of alcohols (that vary by carbon chain length) with a cyclic form of the sugar, glucose or glucose polymers. An example of the chemical structure of an alkyl glucosides is $RO(G)_x$, in which R is a primary linear or 2-methyl-branched aliphatic radical containing 8 to 22 carbon atoms and G is a symbol standing for a glucose unit. The degree of oligomerization x, which indicates the distribution of monoglucosides and oligoglucosides, is a number of 1 to 10.

More preferably, the surfactant of the present invention is caprylyl/decyl glucoside (CAS No. 68515-73-14), Glucopon 215 UP, comprising from about 2 wt. % to about 7.5 wt. % of the cleaning concentrate composition, mostly preferably about 4 wt. % active in the formula. Glucopon is a trademark owned by BASF Corporation, of Ludwigshafen, Germany. Glucopon 215 UP is commercially available in the United States from BASF Corporation, of Florham Park, N.J. Due to its low surface tension and excellent wetting ability, caprylyl/decyl glucoside may also be used as both a surfactant and a wetting agent.

Other surfactant chemical groups may be used in place of, or in combination with, the alkyl glucoside surfactant, including alkyl carboxylates, alkyl polyoxyethylenes, alkyl polysaccharides, alkylamine ethoxylates, amphoterics, amine oxides, polyalkylene glycol, sarcosines, and sarcosinates.

The Fungicide

A fungicide can assist in killing or preventing the growth of fungi in a cleaning concentrate composition, and on the outdoor surface after it is applied. The addition of a fungicide can also increase the effectiveness of a cleaning composition, particularly against yeast, mold or mildew.

The preferred fungicide for use with the present invention is potassium bicarbonate (CAS No. 298-14-6), comprising from about 6 wt. % to about 12 wt. % of the cleaning concentrate composition, mostly preferably about 10 wt. % active in the formula. Potassium bicarbonate is a mold and mildew stain remover, effective against mold and mildew. Potassium bicarbonate may also be used as a preservative, a builder and/or a pH adjuster in the composition. The criteria that should also be considered in selecting an appropriate fungicide include their ability to work in conjunction with the chelating agents, solubility, stability, effectiveness within the expected pH range, toxicity, and biodegradability. Other fungicides that may be used with the present invention include sodium bicarbonate, potassium carbonate, sodium carbonate, silver, cadmium, and sulfur compounds. Certain natural fungicides may also be used with the present invention, including tea tree oil, cinnamon essential oil, jojoba oil, neem oil, rosemary oil, monocerin, milk, and amepelomyces quisqualis AQ10.

The Disinfectant

A disinfectant acts to kill or prevent the growth of microorganisms, especially bacteria—both in the cleaning composition, and on the outdoor surface after it is applied. A disinfectant that acts against fungi may also be used as a fungicide, and vice versa. Potassium carbonate (CAS No. 584-08-7) is a preferred disinfectant/pesticide for use with the present invention, comprising from about 3.5 wt. % to about 9.5 wt. % of the cleaning concentrate composition, most preferably about 5.342 wt. % active in the formula. Potassium carbonate can also be used for pH adjustment—for increasing the pH of the cleaning concentrate composition to the preferred range of about 9.4 to about 9.8. Other disinfectants may include sodium carbonate, lithium carbonate, and ammonium carbonate, amongst other organic disinfectants that are soluble in water.

The combination of the fungicide, preferably potassium bicarbonate, and the disinfectant/pesticide, preferably potassium carbonate, are believed to generate a synergistic effect—when used in combination with other ingredients of the outdoor cleaning concentrate composition described herein—which may yield high stain removing performances, even at lower pH levels, and can also inhibit other bacterial and fungal organisms.

The Chelating Agents

One or more chelating agents are used in the present invention to remove metal ions from the surface to be cleaned. The bacteria and fungi in mold or mildew require certain metal ions, including magnesium, calcium and iron. The chelating agent acts to remove the metal ions from the bacteria and fungi. Without access to the metal ions, the bacteria and fungi cannot thrive, and are then more easily removed from the surface. As such, the chelating agents are particularly needed in the present outdoor cleaning concentrate composition, for use in combination with other ingredients described herein, such as the fungicide (e.g., potassium bicarbonate) and the disinfectant (e.g., potassium carbonate).

Preferably, two chelating agents are used in the present invention. The first preferred chelating agent is sodium gluconate (CAS No. 527-07-1), preferably comprising from about 4 wt. % to about 11 wt. % of the outdoor cleaning concentrate composition, mostly preferably about 9 wt. % active in the formula. Sodium gluconate is available from PMP Fermentation, of Peoria, Ill. The second preferred chelating agent is Trilon M, a solution of the trisodium salt of methyl glycine diacetic acid (CAS No. 164462-16-2), comprising from about 3 wt. % to about 10 wt. % of the outdoor cleaning concentrate composition, mostly preferably about 9 wt. % active in the formula. Trilon is a trademark owned by BASF Corporation, of Ludwigshafen, Germany. Trilon M is commercially available in the United States from BASF Corporation, of Florham Park, N.J. Each of these products are non-toxic biodegradable.

The amount of sodium gluconate that may be added to the composition is limited because of its low solubility. Trilon M has been found to be effective in working with sodium gluconate to extend the chelating function. While Trilon M may be employed as the only chelating agent in composition, such an approach creates higher cost implications. Unexpectedly, the use of Trilon M, in combination with the other compounds described herein, appears to yield high stain (e.g., mold and mildew) removal efficiencies, even at a lower pH level than traditional cleaners.

Also, the combination of sodium gluconate and Trilon M is believed to be more potent in chelating, than either one could be at the same percentage used in the formula singularly. While a key challenge for the concentrated product was to prepare a stable homogenous liquid mixture with a high concentration of solids, the chelating agents as described herein are especially helpful for deactivating the ions—thereby increasing the stability of the outdoor cleaning concentrate composition.

Other chelating agents that may be used with the present invention include L-tartaric acid, potassium sodium tartrate, potassium tartrate, trisodium citrate, monosodium citrate, tripotassium citrate, monopotassium citrate, sodium lactate, and DL-malic acid. Other criteria should be considered in selecting an appropriate chelating agent, including solubility, stability, effectiveness within the expected pH range, effectiveness with the other chelating agents being used, toxicity, and biodegradability The Remaining Ingredients Other components that may be added to the present outdoor cleaning concentrate composition, include a diluent and/or a preservative.

The diluent is preferably deionized water or reverse osmosis water, that can be added to achieve the desired concentrations of the active ingredients in the solution. The diluent of the present invention concentrate may comprise from about 35.5 wt. % to about 80.75 wt. % of the outdoor cleaning concentrate composition. Preferably, the added deionized water comprises about 39.333 wt. % of the composition. While the diluent is not an active component in removing stains, its addition to the outdoor cleaning composition is highly desirable, because the active ingredients are typically available in a highly concentrated form. Therefore, a diluent can reduce the concentrations of the active constituents to their desired amounts.

Finally, one or more preservatives may also be added to increase the effectiveness of the outdoor cleaning composition. A preservative works to prevent the growth of bacteria, yeast and mold in the outdoor cleaning concentrate composition during its manufacture, filling and storage. Preferably, the preservative is sodium lactate (CAS No. 867-56-1), comprising from about 0.75 wt. % to about 2.25 wt. % of the composition, mostly preferably about 0.9 wt. % active in the formula. Sodium lactate may be used to kill bacteria that may be introduced during the manufacturing or filling processes. Additional criteria that should be evaluated in selecting appropriate preservatives include their ability to work in conjunction with the chelating agents, solubility, stability, effectiveness within the expected pH range, toxicity, and biodegradability. Other preservatives that may be used with the present invention include benzisothiazolinone, chlorinated and non-chlorinated isothiazolinones, 2-methyl-4-isothiazolin-3-one (MIT), 3-iodopropargyl-N-butylcarbamate, methyl and benzisothiazolinone, or the combination thereof.

According to the preferred embodiment of the invention disclosed above, the resulting pH of the outdoor cleaning concentrate composition is expected to be about 9.4 to about 9.8. Within this range, the other ingredients of the concentrate composition as disclosed above, have proven to be effective at cleaning dirt and stains, particularly the mold and mildew stain, while not being too corrosive on the surfaces being treated, or for the user. If needed, a pH adjuster may be added to adjust the pH to the desired level, to be determined by the operational ranges of the active ingredients.

The Outdoor Cleaning System

Prior to use, the present outdoor cleaning composition is diluted (e.g., with tap water) to form a diluted cleaner, preferably at a dilution rate of about 1:19. After the dilution, the pH is approximately 0.15 to less than 0.2 pH units higher, and then the pH of the diluted cleaner may range from about 9.55 to less than 10.

The outdoor cleaning system according to the present invention may include a container, which contains the concentrate composition described herein. The container has a sprayer nozzle, which can be attached a garden hose. For instance, the user can first attaches the garden hose to the outdoor cleaning system with the nozzle in "OFF" position. Next, the user may turn on the garden hose to its full pressure, and change the nozzle to "RINSE" position and wet the outdoor surface. The user may then spray the cleaner with the nozzle in "CLEAN" position, and preferably allow the foam to remain on the surface for about 10 minutes. Finally, the user can change the nozzle to "RINSE" position again and rinse the surface, as well as the surrounding vegetation and cement. Only when a heavy buildup of mildew is present, a bristle brush may need to be used.

The following example is given to illustrate the outdoor cleaning concentrate composition of the present invention, but is not intended to limit the invention to the example included herewith. The following example specifically illustrates an exemplary and preferred formulation of the outdoor cleaning concentrate composition according to the present invention. It is to be understood that the examples are presented by means of illustration only and that further use of formulations that fall within the scope of the present invention and the claims herewith may be readily produced by one skilled in the art with the present disclosure before them.

Preparation of the Solution Formulation

An example formulation illustrating an embodiment of the inventive outdoor cleaning concentrate composition of the present invention is described in detail in Table 1 below and was formulated generally in accordance with the following protocol.

EXAMPLE 1

Outdoor Cleaning Concentrate Composition Formulation 1

An outdoor cleaning concentrate composition according to the first embodiment of the present invention was prepared, by introducing appropriate amounts of the indicated constituents, so as to attain the desired relative weight percentages indicated in Table 1 hereinafter, by first charging deionized water into a tank equipped with a mixer. Glucopon 215 UP was then added to the tank, and mixed until the solution was completely dispersed. The first chelating agent, sodium gluconate, was then added, and mixed for about 45 minutes until the solution was homogenous and clear. The preservative sodium lactate (60%, Purasal S from Purac) was then added, and mixed for about 15 minutes. The second chelating agent, Trilon M, was then added, and mixed for about 30 minutes. The fungicide/preservative/builder potassium bicarbonate was then added, and mixed for about 50-60 minutes until the solution was clear. Finally, the disinfectant/pH adjustor potassium carbonate was added to adjust the pH.

Inasmuch as various ones of the raw material components of the outdoor cleaning concentrate composition are purchased in a form that is at least partially diluted with water, Table 1 provides the percentage of each component which is active in the raw material, the percentage of each particular component (active material and any water in the raw material solution) in the formula and the percentage of each component in the active portion of the formula. This formula contains more than 39% of solids on a dry weight basis, and of that amount, 18 wt. % are powders.

TABLE 1

Outdoor Cleaning Concentrate Composition Formulation 1

| Ingredient Name | % Active in Raw Material | % in Formula | % Active in Formula |
|---|---|---|---|
| Deionized Water | | 39.333 | N/A |
| Potassim Bicarbonate (Armand Products) | 100 | 10.000 | 10.000 |

TABLE 1-continued

| Outdoor Cleaning Concentrate Composition Formulation 1 | | | |
|---|---|---|---|
| Ingredient Name | % Active in Raw Material | % in Formula | % Active in Formula |
| Sodium Gluconate (PMP Fermentation) | 100 | 9.000 | 9.000 |
| Trilon M solution (BASF) | 40 | 22.500 | 9.000 |
| Potassium Carbonate | 47 | 11.367 | 5.342 |
| Caprylyl/Decyl Glucoside (BASF) | 63.5 | 6.300 | 4.000 |
| Sodium Lactate (Purac) | 60 | 1.500 | 0.900 |

Testing of Example Composition Formulation

The outdoor cleaning concentrate composition of the present invention was evaluated for cleaning performance, in comparison to three commercially available reference concentrates that are currently marketed as outdoor cleaners or house wash products. Outdoor Cleaning Concentrate Composition Formulation 1 (Formulation 1) was diluted and subjected to testing to measure the formulation's foam quality, quantity and duration, as detailed in Table 2. The tests were conducted in clear 4,000 ml breakers, in 5 gallon plastic pails, and on painted aluminum house siding; and were all timed—timing dependent on whether house siding or what kinds of containers were used. The stable foam quality and quantity can indicate that the tested product has the potential for better cleaning properties.

TABLE 2

| Comparison Testing of Formulation 1 | | | | |
|---|---|---|---|---|
| | Formulation 1 | Reference A | Reference B | Reference C |
| pH of Concentrated Product | 9.4-9.8 | 10-11 | 10-12 | ≥10.5 |
| Surfactant | Caprylyl/ Decyl Glucoside | Ethoxylated Alcohol | Proprietary Ethoxylated Alcohol | SDS Not Found |
| Wetting Agent | Caprylyl/ Decyl Glucoside | Sodium Xylene Sulfonate Hydrotrope | None | SDS Not Found |
| Builder; pH Adjuster | Potassium Bicarbonate; Potassium Carbonate | Sodium Carbonate | Sodium Metasilicate | Sodium Percarbonate |
| Dilution Rate | 1:19 | 1:9 | 1:9 | 1:9 |
| Foam Quality and quantity | Formulation 1 ≥ Reference C > Reference B > Reference A | | | |

As shown above, Formulation 1's 1:19 dilution performance was even better the 1:9 dilution performance of either reference A or B—and was at least as good as, or even better than, the 1:9 dilution performance of Reference C. In addition, Outdoor Concentrate Cleaning Composition Formulation 1 has a lower pH (e.g., from about 9.4 to about 9.8) than the reference products (all of which have a pH higher than 10). As such, Outdoor Cleaning Concentrate Composition Formulation 1 has significant other benefits over the reference products, in that it is less likely to corrode the surfaces that are treated, and have lower odor associated with its use. Furthermore, the reference products are not believed to meet all of the same environmental standards, and thus may not be available, unless changed, if consumers or regulatory bodies further limit such products. Notably, references A, B and C each claim to be suitable for removing mold and mildew, in which each has a pH of 10.0 or higher. Despite its lower pH, upon testing, Formulation 1 has proven to be better at removing mold and mildew than any of references A, B or C.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the broadest scope consistent with the principles and novel features disclosed herein.

The invention claimed is:

1. An outdoor cleaning concentrate composition comprising:

a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates;

a fungicide, comprising about 6 wt. % to about 12 wt. % of the composition;

a chelating agent; and a disinfectant comprising potassium carbonate, wherein the pH of the concentrate composition ranges from about 9.4 to about 9.8.

2. The composition according to claim 1, in which the surfactant comprises about 2 wt. % to about 7.5 wt. % of the composition.

3. The composition according to claim 1, in which the surfactant has a low surface tension.

4. The composition according to claim 1, in which the surfactant comprises an alkyl glucoside.

5. The composition according to claim 4, in which the surfactant is caprylyl/decyl glucoside.

6. The composition according to claim 1, in which the fungicide is selected from the group consisting of potassium bicarbonate, sodium bicarbonate, potassium carbonate, sodium carbonate, silver, cadmium, sulfur, tea tree oil, cinnamon essential oil, jojoba oil, neem oil, rosemary oil, monocerin, milk, and amepelomyces quisqualis AQ10.

7. The composition according to claim 6, in which the fungicide is potassium bicarbonate.

8. The composition according to claim 1, in which the disinfectant comprises about 3.5 wt. % to about 9.5 wt. % of the composition.

9. The composition according to claim 1, in which the chelating agent is selected from the group consisting of sodium gluconate, a salt, of methyl glycine diacetic acid, L-tartaric acid, potassium sodium tartrate, potassium tartrate, trisodium citrate, monosodium citrate, tripotassium citrate, monopotassium citrate, sodium lactate, and DL-malic acid.

10. The composition according to claim 9, in which the chelating agent is selected from the group consisting of sodium gluconate and a salt of methyl glycine diacetic acid.

11. The composition according to claim 1, in which the chelating agent is a first chelating agent, in which the composition further comprises a second chelating agent.

12. The composition according to claim 11, in which the total amount of the chelating agents ranges from about 7 wt. % to about 21 wt. % of the composition.

13. The composition according to claim 11, in which the first chelating agent and the second chelating agent are two different compounds selected from the group consisting of sodium gluconate, a salt of methyl glycine diacetic acid, L-tartaric acid, potassium sodium tartrate, potassium tartrate, trisodium citrate, monosodium citrate, tripotassium citrate, monopotassium citrate, sodium lactate, and DL-malic acid.

14. The composition according to claim 13, in which the first chelating agent is sodium gluconate, and the second chelating agent is a salt of methyl glycine diacetic acid.

15. The composition according to claim 14, in which the first chelating agent comprises about 4 wt. % to about 11 wt. % of the composition.

16. The composition according to claim 14, the first chelating agent comprises about 4 wt. % to about 11 wt. % of the composition.

17. The composition according to claim 1, in which the composition further comprises at least one preservative.

18. The composition according to claim 17, in which the preservative comprises about 0.75 wt. % to about 2.25 wt. % of the composition.

19. The composition according to claim 17, in which the preservative comprises sodium lactate.

20. The composition according to claim 1, in which the composition further comprises a diluent.

21. The composition according to claim 20, in which the diluent comprises about 35.5 wt. % to about 80.75 wt. % of the composition.

22. The composition according to claim 1, in which the composition is diluted to form a diluted outdoor cleaner for cleaning dirt and stains from an outdoor surface.

23. The composition according to claim 22, in which the diluted outdoor cleaner effectively removes mold and mildew stains.

24. The composition according to claim 22, in which the composition is diluted with water at a dilution rate of about 1:19.

25. The composition according to claim 24, wherein the diluted cleaner has a pH ranging from about 9.55 to less than 10.

26. The composition according to claim 1, in which the invention further comprises a container for containing said outdoor cleaning concentrate composition, said outdoor cleaning concentrate composition being constituted to be diluted with water to form a diluted cleaner, in which the container is configured to cooperate with a sprayer nozzle attachable to a garden hose, for spraying the diluted cleaner onto, and for rinsing the diluted cleaner from, one or more outdoor surfaces, with a stream of water passing through said garden hose, said nozzle and said, container.

27. The composition according to claim 26, in which the invention is used for removing mold and mildew stains from said one or more outdoor surfaces.

28. An outdoor cleaning composition comprising:

a surfactant comprising caprylyl/decyl glucoside, ranging from about 2 wt. % to about 7.5 wt. % of the composition;

a fungicide comprising potassium bicarbonate, ranging from about 6 wt. % to about 12 wt. % of the composition;

a disinfectant comprising potassium carbonate, ranging from about 3.5 wt. % to about 9.5 wt. % of the composition;

one or more chelating agents, ranging from about 7 wt. % to about 21 wt. % of the composition;

a preservative comprising sodium lactate, ranging from about 0.75 wt. % to about 2.25 wt. % of the composition; and a diluent, ranging from about 35.5 wt. % to about 80.75 wt. % of the composition, wherein the composition has a pH ranging from about 9.4 to about 9.8.

29. The composition according to claim 28, in which said one or more chelating agents comprises two chelating agents, a first chelating agent comprising sodium gluconate and a second chelating agent comprising a salt of methyl glycine diacetic acid.

30. An outdoor cleaning concentrate composition comprising:

a surfactant comprising caprylyl/decyl glucoside;

a fungicide;

a chelating agent; and a disinfectant comprising potassium carbonate, wherein the pH of the concentrate composition ranges from about 9.4 to about 9.8.

31. An outdoor cleaning concentrate composition comprising:

a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates;

a fungicide;

a first chelating agent;

a second chelating agent, wherein the total amount of the first and second chelating agents ranges from about 7 wt. % to about 21 wt. % of the composition; and a disinfectant comprising potassium carbonate, wherein the pH of the concentrate composition ranges from about 9.4 to about 9.8.

32. An outdoor cleaning concentrate composition comprising:

a surfactant selected from the group consisting of alkyl glucosides, alkyl carboxylates, alkyl polyoxyethylenes, alkyl polysaccharides, alkylamine ethoxylates, amphoterics, amine oxides, polyalkylene glycol, sarcosines and sarcosinates;

a fungicide;

a chelating agent; and a disinfectant comprising potassium carbonate, ranging from about 3.5 wt. % to about 9.5 wt. % of the composition, wherein the pH of the concentrate composition ranges from about 9.4 to about 9.8.

* * * * *